US006196212B1

(12) United States Patent
Taplan et al.

(10) Patent No.: US 6,196,212 B1
(45) Date of Patent: Mar. 6, 2001

(54) GAS COOKING APPARATUS AND COOKING VESSEL SUPPORT FOR SAME

(75) Inventors: Martin Taplan, Rheinboellen; Herwig Scheidler, Mainz; Michael Kahlke, Bingen; Christof Koester, Muelheim an der Ruhr; Eva Haase, Frankfurt, all of (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/244,934

(22) Filed: Feb. 4, 1999

(30) Foreign Application Priority Data

Sep. 29, 1998 (DE) ..... 198 44 551

(51) Int. Cl.[7] ..... F24C 3/08
(52) U.S. Cl. ..... 126/39 R; 126/215
(58) Field of Search ..... 126/39 K, 39 R, 126/39 H, 39 E, 214 R, 215

(56) References Cited

U.S. PATENT DOCUMENTS

| | | | | |
|---|---|---|---|---|
| 1,942,265 | * | 1/1934 | Teller et al. | 126/39 R |
| 2,530,183 | * | 11/1950 | Smallwood | 126/214 R |
| 2,611,358 | * | 9/1952 | Taylor | 126/39 K |
| 3,592,180 | * | 7/1971 | Kweller et al. | 126/39 H |
| 3,625,196 | * | 12/1971 | Craver | 126/214 R |
| 3,874,841 | * | 4/1975 | Ferlin | 126/39 E |
| 5,046,477 | * | 9/1991 | Bennett et al. | 126/39 R |

FOREIGN PATENT DOCUMENTS

| | | |
|---|---|---|
| 41 44 409 A1 | 4/1993 | (DE) . |
| 44 42 572 C1 | 9/1995 | (DE) . |
| 195 05 469 C1 | 2/1996 | (DE) . |
| 43 26 945 C2 | 10/1996 | (DE) . |
| 0 581 655 A1 | 2/1994 | (EP) . |
| 2 693 256 | 1/1994 | (FR) . |

* cited by examiner

*Primary Examiner*—Ira S. Lazarus
*Assistant Examiner*—Sara Clarke
(74) *Attorney, Agent, or Firm*—Michael J. Striker

(57) ABSTRACT

The cooking apparatus includes a glass or glass-ceramic plate (1) providing a cooking surface with a cooking area and provided with a throughgoing opening (2) in the cooking area; a gas burner (3, 19, 21) arranged in or under the throughgoing opening (2) in the glass or glass-ceramic plate (1), which has a burner ring (3*b*) for supporting an open flame (3*a*, 19*a*, 21*a*); a cooking vessel support (5,5*a*) arranged on the glass or glass-ceramic plate over the throughgoing opening (2) which has a resting surface for a cooking vessel (6) and a device for supplying a mixture of combustible gas and primary air to the burner ring (3*b*) to form the open flame, whereby substantially all of the secondary air is drawn from a chamber or space under the glass or glass-ceramic plate (1). Because the secondary air is drawn from below the glass or glass-ceramic plate the height of the resting surface of the cooking vessel support (5,5*a*) can be substantially reduced to less than 10 mm without impairing the combustion process.

3 Claims, 8 Drawing Sheets

GAS COOKING APPARATUS AND COOKING VESSEL SUPPORT FOR SAME

BACKGROUND OF THE INVENTION

1. Field of the Invention

The present invention relates to a gas cooking apparatus with a glass/glass-ceramic plate providing a cooking surface which has at least one cooking area, with a gas burner whose burner ring is supplied a mixture of gas and primary air to form an open flame and which is associated with an opening in the glass/glass-ceramic plate and with a cooking vessel support arranged over the gas burner.

The present invention also relates to a cooking vessel support for this type of cooking apparatus.

2. Prior Art

A gas cooking apparatus with a glass-ceramic plate providing a cooking surface and cooking area, which is heated electrically, has been marketed commercially for more than two decades. These glass-ceramic cooking units are valued because of their pleasing appearance, the flat work surface and the ease with which they are cleaned. Because of these definite, highly esteemed advantages which are associated with glass-ceramic material as a cooking surface material, for a few years now attempts have been made to use this material in gas cooking apparatus or in cooking units with electrically heated cooking zones combined with gas burners, the so-called mixed or duo-units.

Two types of gas cooking apparatus have been built with this type of cooking surface. In one type a radiant gas burner is provided which is arranged under a cooking area on a closed glass-ceramic plate. In this type of gas burner the gas is burned on the surface of a burner plate made from porous and/or perforated ceramic material or from a fleece, fiber mat or web of ceramic or metal fibers. The radiant heat produced thereby is the essential component of the heat supplied to the heating area or zone. This kind of cooking apparatus unit is for example disclosed in German Patent Document DE 43 26 945 C2.

In the second type conventional atmospheric gas burners, i.e. those with an open flame, arising from holes provided in the largely sealed glass-ceramic plate, are used. The respective cooking vessel is placed on the so-called cooking container support, which is placed on the glass-ceramic plate. Moreover the so-called hybrid burner is known, in which a portion of the energy is also transmitted to the vessel by radiation besides the energy transfer by convection that occurs with an open flame.

The present invention is based on a gas cooking apparatus with gas burner having an open flame, for example as disclosed in the German Patent Documents DE 195 05 469 C1, DE 41 33 409 A1 or DE 44 42 572.

In cooking apparatus of the above-described type the respective cooking vessels typically are supported at the height of the cooking container or vessel support at a higher level than that of the conventional cooking surface that is provided by the glass/glass-ceramic plate. This has been found to be very troublesome especially in the above-mentioned duo-apparatus with electro-cooking areas and gas burner areas. The stability of the cooking vessels is seen to be a problem because of the large height differences between the gas burner areas and the electro-burner areas.

Combustion engineering considerations place a limit on efforts to keep the cooking vessel support as small as possible in the known embodiment of the gas burner positions.

A portion of the required combustion air is supplied as primary air with the gas stream at the known gas burner positions with gas burners having open flames. In the above-cited 195 05 469 C1 the primary air is supplied at the side of the glass-ceramic plate through suitable air entrance openings from outside into the space under the glass-ceramic plate. In the above-cited DE 44 42 572 C1 the supply of primary air occurs from outside under the glass-ceramic plate through aeration slots in the bushing ring, with which the opening in the glass-ceramic plate for the gas burner is enclosed. In both cases the supplied primary air from the outside is mixed with the gas fed to the burner by means of known devices. The remaining combustion air is guided to the flame as secondary air from above, i.e. above the glass-ceramic plate into the space between the vessel bottoms, flowing in from outside. Also the burned exhaust gas must be fed into the same space. For this reason minimization of the spacing between the glass-ceramic cooking surface and the bottom sides of the cooking vessels and thus the vessel support height is required in order to provide clean combustion and an efficient energy transfer.

When the bottom side of the cooking vessel is too close to the flame of the atmospheric burner, the exhaust gas quality is clearly poorer and the flames wander to the exterior in order to obtain secondary air required for combustion, whereby the energy transfer would be dramatically poorer, and, on account of unburned gas ingredients, the flames could flash back in a detonation or with a puff on removal of the cooking vessel from the cooking apparatus. Furthermore there is a danger that the flames come up to the vessel.

The currently known atmospheric burner thus requires a vessel support height of from 30 to 60 mm because of this reason. As a result there is a cooking vessel instability risk due to this height difference between the two different cooking planes (gas cooking plane and electro-cooking plate) or between the gas cooking plane and the height of the working plate and the ergonomics is not optimum.

SUMMARY OF THE INVENTION

It is an object of the present invention to clearly reduce the vessel support height required because of combustion engineering considerations while retaining the conventional exhaust gas quality and the efficiency of the gas burner, to clearly reduce the risk of cooking vessel instabilities due to the different heights of different areas and to improve the ergonomics of the cooking apparatus.

According to the invention the cooking apparatus of the above-described kind includes means for supplying substantially all of the primary and secondary air for combustion from the chamber or space under the glass/glass-ceramic plate to the open flame or flame region of the gas burner.

Because of the features according to the invention conventional vessel support height in the current atmospheric burner can be reduced in a surprising manner. In the case of the invention the secondary air is not guided from the outside to the flame from the upper side of the cooking surface, but instead from a level under the bottom side of the cooking surface of the cooking apparatus, i.e. from the cooking apparatus interior. Because of this very simple, but completely effective measure the spacing of the cooking surface to the vessel bottom can be reduced to the extent that only the still cleanly burned exhaust gas, which flows directly to the bottom of the cooking vessel must be exhausted and simultaneously a secondary air supply need not be secured from the outside. This simple feature has the surprising consequence that a definite reduction of the vessel support height to a height not greater than 25 mm results for the known atmospheric gas burner. In the current atmospheric gas burner which requires a vessel support height of 30 mm in the currently known structure in order to guarantee optimum combustion and sufficient energy transfer, a reduction of the vessel support height of only 5 mm causes about a 10-fold increase in the Co exhaust gas content. When a secondary air supply according to the invention is guaranteed from the cooking apparatus interior, the CO exhaust gas content remains substantially unchanged.

In conventional structures the reduction of the container or vessel support height had a negative effect, namely the flames are lowered and wander to the outside because of an insufficient air supply in addition to the negative effect already mentioned above. Because of that energy transfer is understandably considerably reduced. Also this effect is avoided by secondary air supply from the cooking apparatus interior through the opening in the glass-ceramic plate directly to the flame region of the gas burner. Based on this simple feature and the resulting positive effect an entirely new structural unit may be designed for gas and duo-units. A desire for increased stability for the vessels placed on the cooking apparatus and improved ergonomics can thus be fulfilled.

The clearly reduced vessel support height also exerts a decisive positive influence on the esthetics of the cooking apparatus.

In an especially preferred embodiment a blower is arranged in the chamber or space under the glass/glass-ceramic plate to assist in supplying secondary air.

In principle the structure can be designed so that the burner ring of the gas burner can be located inside or above or below the opening in the glass/glass-ceramic plate.

In a preferred embodiment of the invention the cooking apparatus is formed with a gas burner inside the opening so that the gas burner, which is a cylindrical atmospheric burner, is received in the opening with its burner ring projecting above the cooking surface, and at least one passage in the glass/glass-ceramic plate is formed for conduction of secondary air from the chamber or space under the glass/glass-ceramic plate upward through the plate to the flame region/burner ring of the gas burner.

This concept allows a simple structure for the embodiments of the invention in a cylindrical atmospheric gas burner.

According to a first form of these embodiments the arrangement is designed so that an annular gap for passage of secondary air is formed between the edge of the opening for the gas burner in the glass/glass-ceramic plate and the casing of the gas burner received in it.

According to another form of these embodiments the gas cooking apparatus is designed so that the glass/glass-ceramic plate has a cutout section forming a feed opening for secondary air in the vicinity of the opening for the gas burner and the annular gap between the burner casing and the edge of the opening for the burner is covered by an cover plate.

This latter form eliminates an open or free space between the burner case in the edge of the opening, through which material from the cooking vessels which overflows from them can fall, but necessarily increases expenses for construction of the glass/glass ceramic plate.

In the embodiment with gas burner arranged under the opening the cooking apparatus is constructed according to another form of the invention so that the gas burner is arranged as an atmospheric circular burner under or at the same height as the opening in the glass/glass-ceramic plate and the supply of secondary air to the flame region occurs from the side and/or from under the circular burner.

Alternatively also the cooking unit can be formed so that the gas burner, formed as a hybrid burner, is arranged under or at the same height as the opening in the glass/glass-ceramic plate and the combustion air is supplied from the space under the glass/glass-ceramic plate.

The glass/glass-ceramic plate can be formed so that it is even with or in the same plane as the opening which can be enclosed with an overflow collar. Alternatively to avoid overflow of material from the cooking vessels through the opening in the cooking apparatus the edge of the opening can be curved upward. If necessary a collector device or gutter can be thereby formed, which borders the cooking area.

Because of the method of air supply according to the invention it is possible to provide a new vessel or pot support in which the support height is less than 25 mm, preferably less than 10 mm, so that the danger of instability of the cooking vessels is clearly reduced.

The embodiments described above may be redesigned in a simple manner with non-cylindrical geometries, for example as an oval fish fryer or triangular or square burner.

BRIEF DESCRIPTION OF THE DRAWING

Additional features, objects and advantages of the invention are made more apparent from the embodiments described in detail in the following detailed description with the aid of the accompanying drawing, which show a cooking apparatus provided with a glass-ceramic plate as a cooking surface and in which all the features of the apparatus are shown to scale for improved illustration, wherein.

DESCRIPTION OF THE PREFERRED EMBODIMENTS

Figure 1:
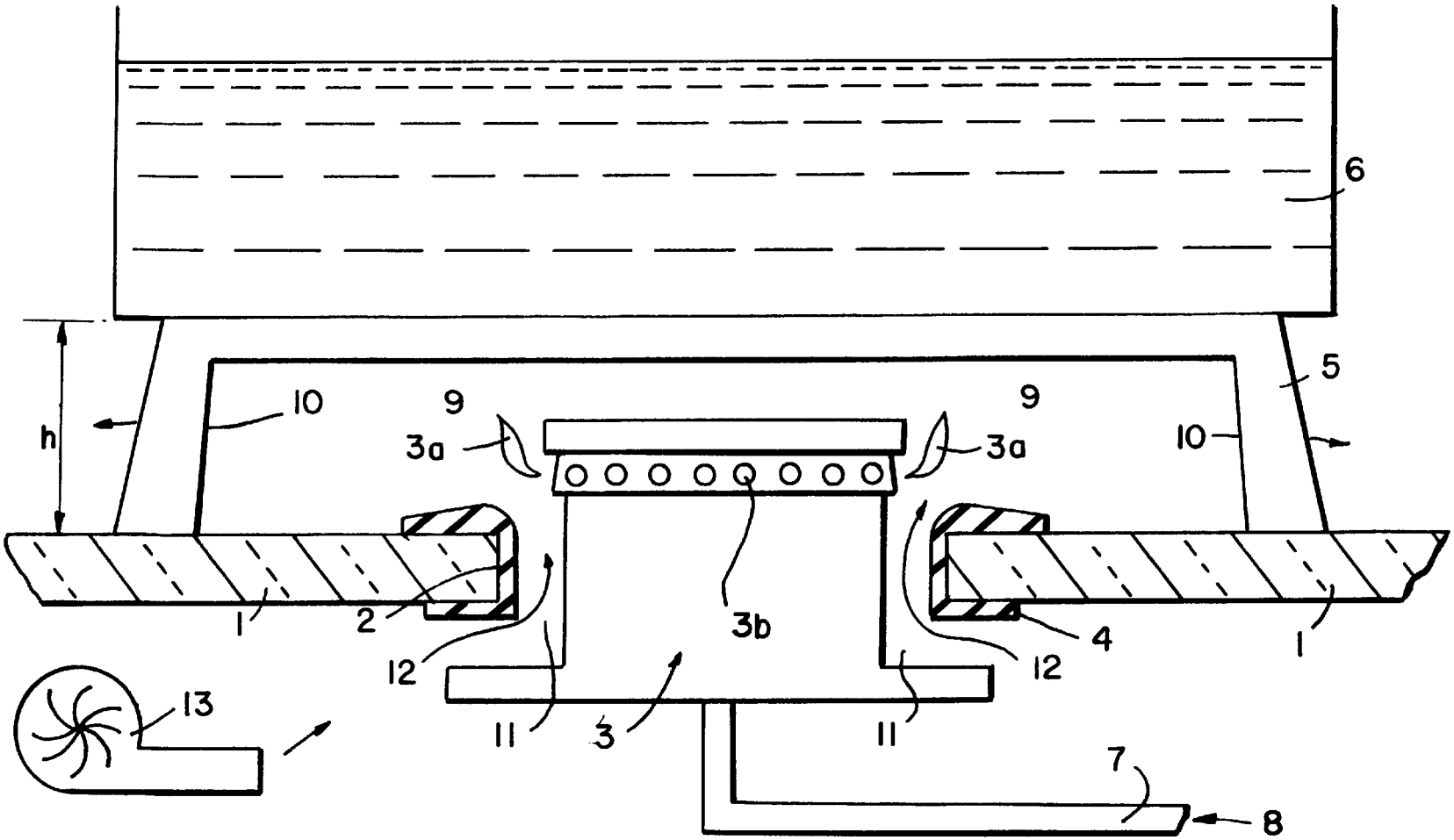
FIG. 1 is a schematic side cross-sectional view through one embodiment of the cooking apparatus according to the invention having a plane structure in the region of the opening in the glass-ceramic plate and a cylindrical atmospheric burner mounted in the opening with the secondary combustion air supplied through an annular gap between the opening edge and the burner casing.

FIG. 1 shows a gas burner area of a cooking apparatus according to the invention with a glass-ceramic plate 1 providing a cooking surface which has an opening or passage 2 in which an atmospheric burner 3 of the conventional type is received with symbolically indicated flames 3*a* and which is enclosed in a circular sleeve 4, as is already known from the previously cited German Patent Document DE 44 42 572 C1.

A conventional cooking vessel support 5 with a definite support height "h" is arranged on the burner 3, on which a cooking vessel 6 is diagrammatically shown in FIG. 1.

FIG. 1 shows only a single gas burner area of the cooking apparatus but it is understood that the cooking apparatus can have several of this type of gas burner areas. A so-called duo cooking apparatus can be provided, with a combination of at least one gas burner position according to FIG. 1 and at least one electrically heated cooking zone.

In the following FIGS. 2 to 8 the gas burner areas shown are suitable for combination with one or more gas burner areas and/or electrically heated cooking zones and in these embodiments one single gas burner area or position is shown.

A pure gas 8, which is later mixed with the so-called primary air, or a gas mixture 8 of the combustible gas and primary air is fed to the burner 3 over a supply pipe 7 according to the particular embodiment of the burner. This gas mixture is burned in the space 9 between the glass-ceramic plate 1 and the bottom of the cooking vessel 6, whereby the exhaust gas 10 flows away to the outside between the legs of the vessel support 5.

An air gap 11, through which the secondary air 12 required for combustion can pass up into the combustion chamber or space 9 between the bottom of the cooking vessel 6 and the glass-ceramic plate 1 from a space under the glass-ceramic plate 1, is located between the burner 3 and a circular sleeve 4.

Because of the illustrated air supply method the distance of the glass-ceramic plate from the cooking vessel bottom can be considerably reduced with great advantage. The support height "h" in the conventional burner system is between 30 and 60 mm in the conventional prior art burner system. In the embodiment illustrated the vessel support height "h" is less than 15 mm while the exhaust quality is maintained and the energy consumption is the same. The danger of instability of the cooking vessel 6 can thus be clearly reduced.

An additional advantage for this principle is that the secondary air 12 is supplied directly to the flames on the burner ring 3*b* and because of that a decrease in the flames is avoided with greatly reduced vessel support height.

The supply of secondary air 12 can be assisted by a blower 13 in order to improve the control and combustion characteristics of the flames. This blower 13 can actively assist the combustion process, but also can be used to accelerate the exhaust process when the burner flames are shut off, and thus increase still further the reaction properties of the cooking system.

Figure 2:
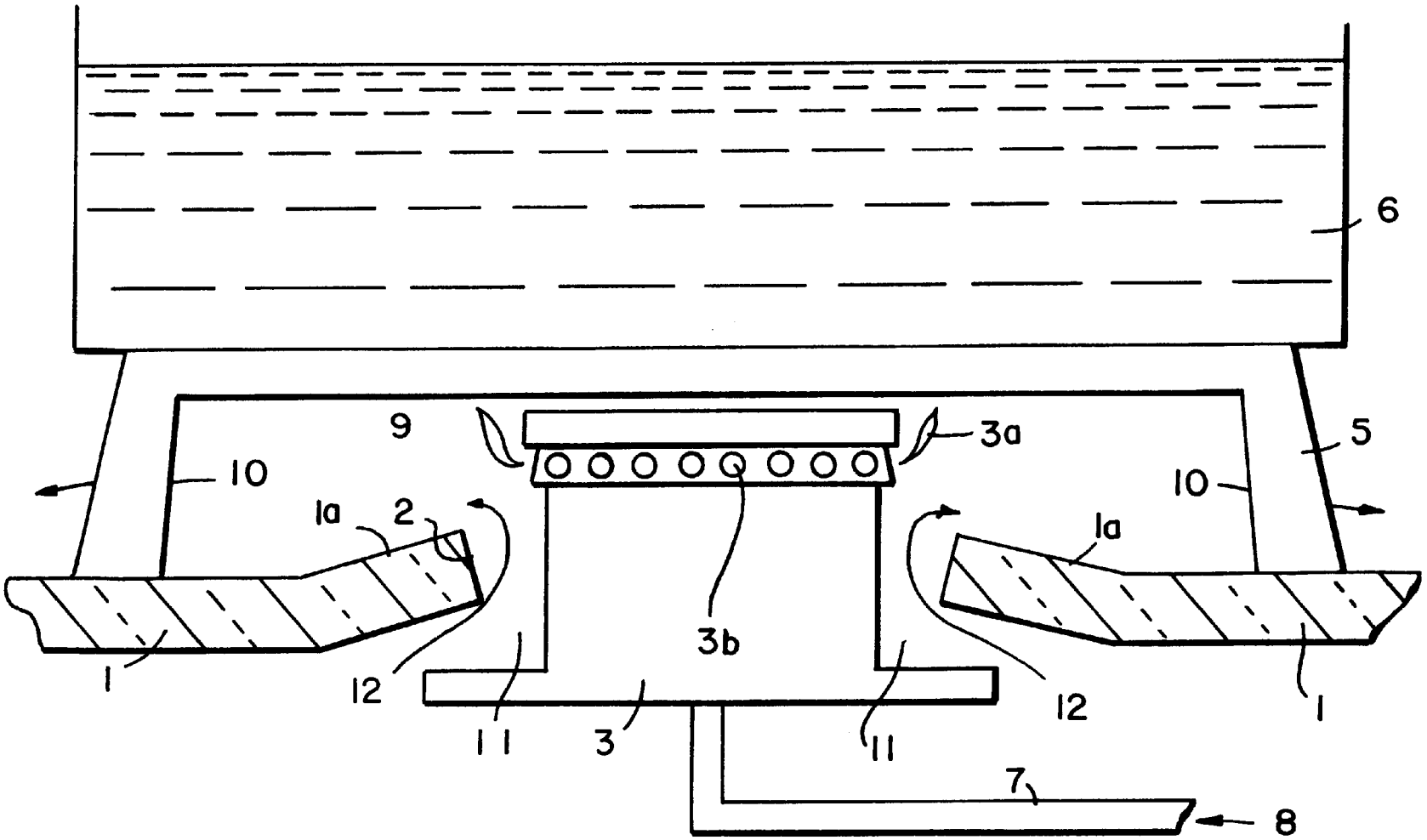
FIG. 2 is a schematic side cross-sectional view of another embodiment of the cooking apparatus according to the invention that is similar to that of FIG. 1, however with the edge of the opening bent or turned upward as a protection against overflow from the cooking vessels.

A further embodiment of the invention is shown in FIG. 2 that differs from the embodiment shown in FIG. 1 only in the structure of the edge region of the passage or opening 2. In order to provide overflow protection, i.e. to guarantee that cooking material that flows out of the vessel 6, does not enter the interior of the cooking apparatus through the annular gap 11, the edge 1*a* of the opening or passage in the glass-ceramic plate 1 is curved or otherwise turned or directed upward. The circular sleeve or collar 4 used in the embodiment of FIG. 1 can be dispensed with in this embodiment because of that.

Other features and elements in the embodiment of FIG. 2 that are the same as in the embodiment of FIG. 1 and function in the same manner are provided with the same reference number. The supply of secondary air is assisted by a blower 13 (which is not shown in FIG. 2) in the embodiment shown in FIG. 2 which is like that shown in FIG. 1.

Figure 3:
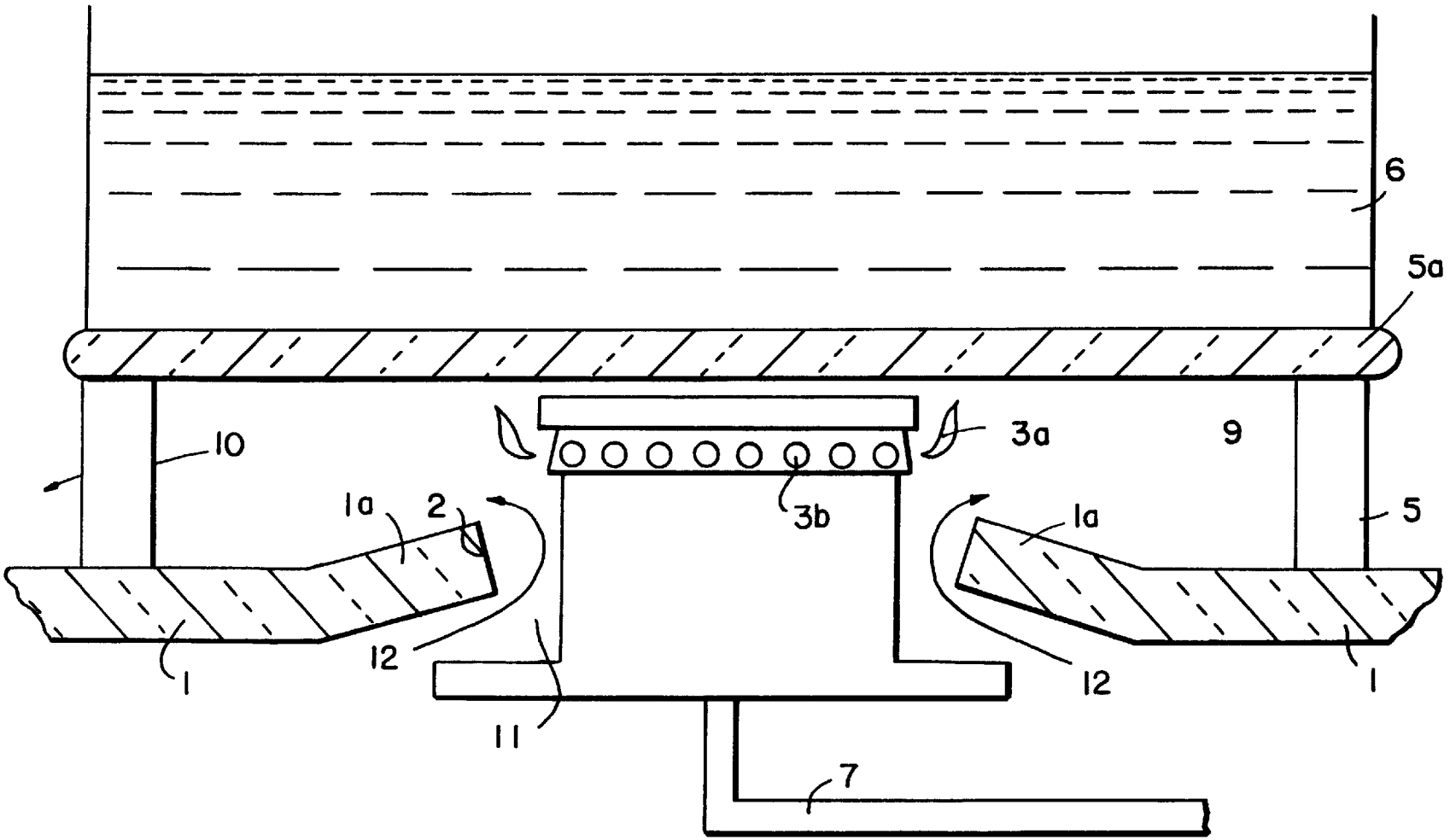
FIG. 3 is a schematic side cross-sectional view of a further embodiment of the cooking apparatus according to the invention that is similar to that of FIG. 2, in which there is however a glass-ceramic disk used in or as a part of the cooking vessel support.

The embodiment shown in FIG. 3, with the exception of the vessel support 5, is identical with that according to FIG. 2. In this embodiment the resting surface on the cooking vessel on the vessel support is made of a material that corresponds to that of the cooking surface 1, i.e. preferably by a glass-ceramic plate 5*a*. The entire appearance of the cooking apparatus and the ease of cleaning are positively benefited by this design.

This vessel support can naturally be used in connection with the embodiment shown in FIG. 1.

Figure 4:
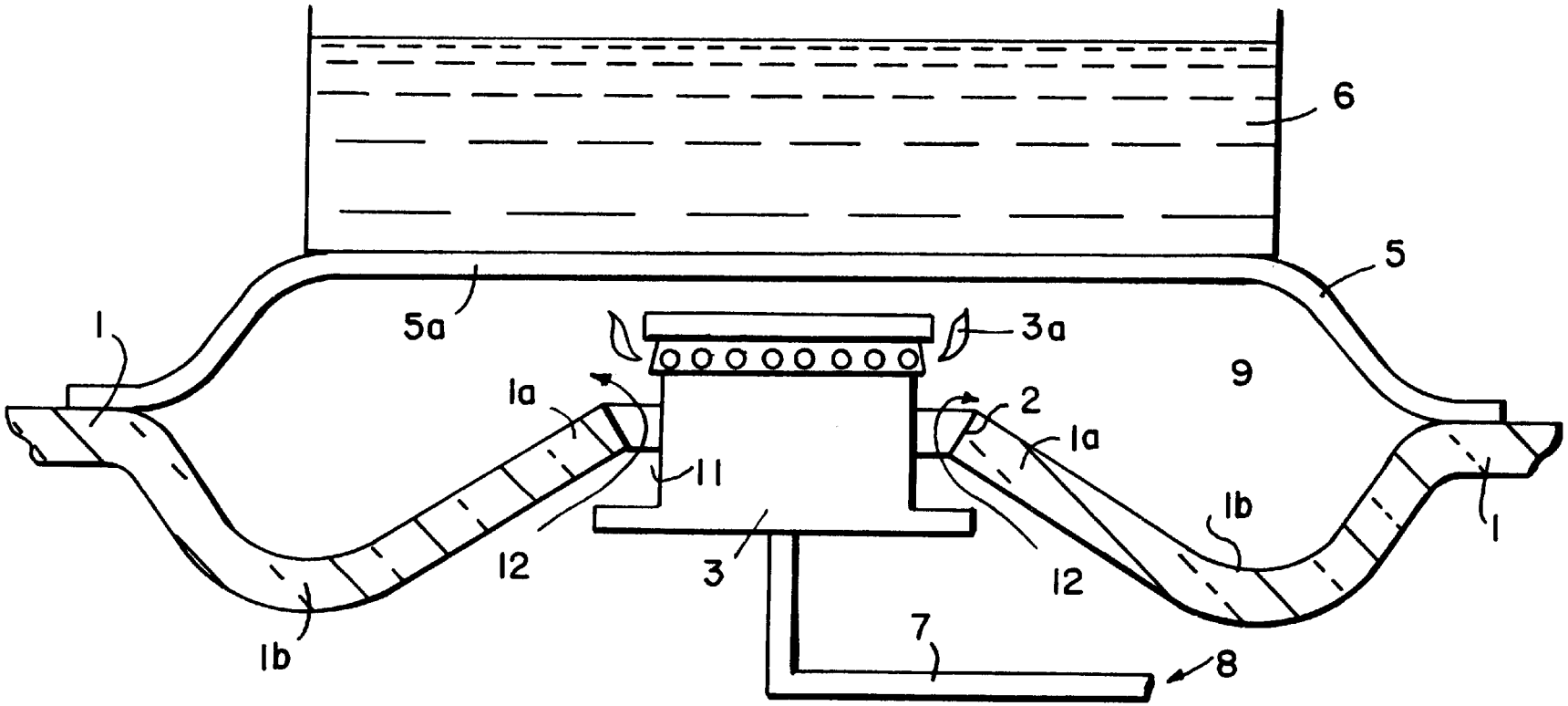
FIG. 4 is a schematic side cross-sectional view of an additional embodiment of the cooking apparatus similar to that in FIG. 2 but with a lowered collecting gutter for collection of any overflow from the cooking vessels.

In the embodiment according to FIG. 4 the plate 1 has a circular gutter 1*b* clearly stamped out in it which is bordered by the upwardly directed edge 1*a* of the cooking surface 1, so that overflow will not run off of the cooking surface.

Besides what can be used in the embodiments of FIGS. 1 to 3, can be used in the embodiment according to FIG. 4.

FIG. 4 shows a modification of the vessel support 5. While the vessel support has substantially straight legs in the embodiments according to FIGS. 1 to 3, they are curved in the embodiment according to FIGS. 4 and 5, but the curved embodiments for the vessel support can also be used in the embodiments according to FIGS. 1 to 3. Also in the curved embodiment of the vessel support according to FIG. 4 the resting place 5*a* for the vessel 6 can be formed by a glass-ceramic panel or plate according to the embodiment of FIG. 3.

Figure 5:
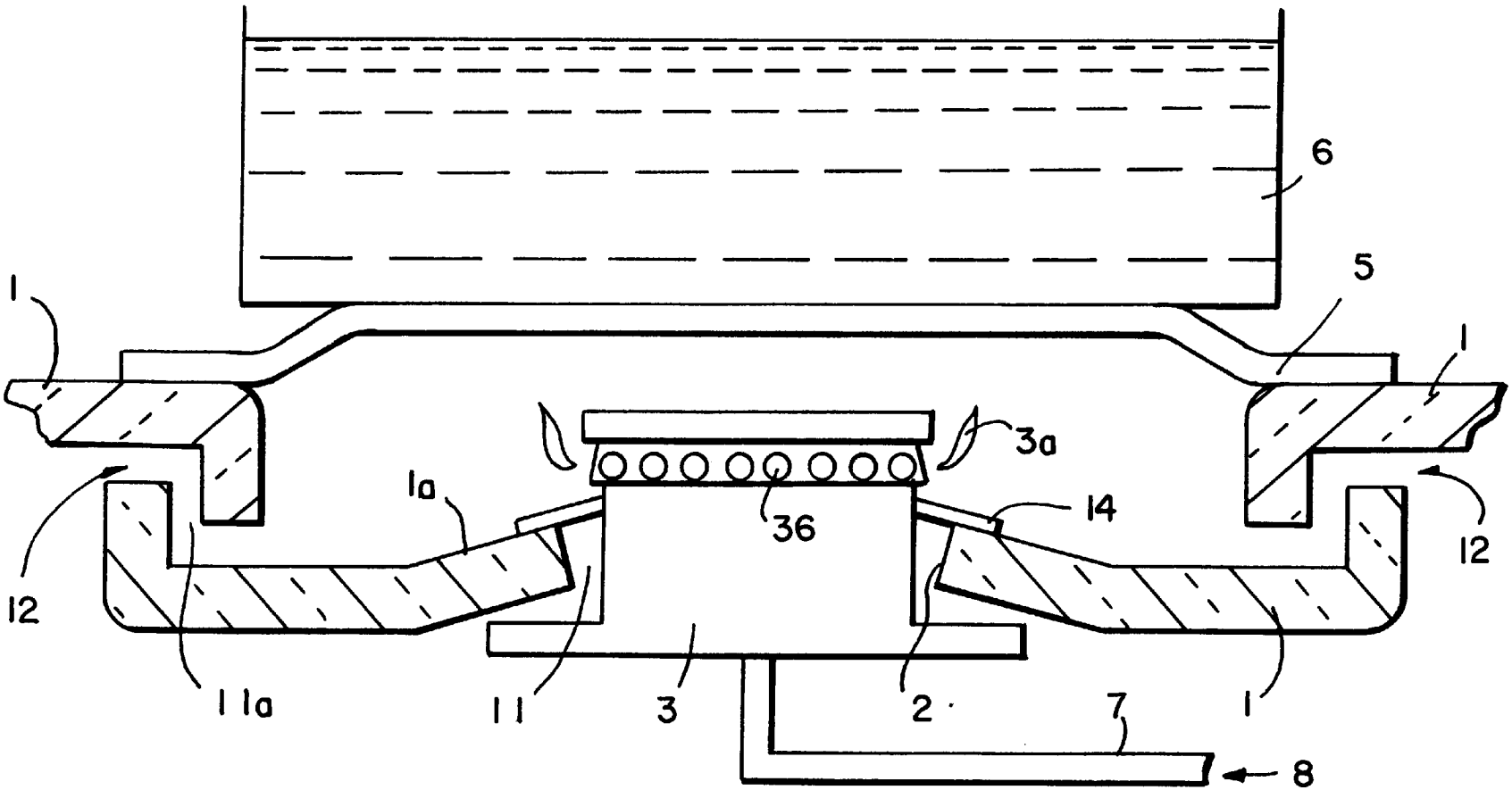
FIG. 5 is a schematic side cross-sectional view of another embodiment analogous to that shown in FIG. 2, but with a secondary air feed from an outer region of the burner by means of special passages formed in the glass-ceramic plate.

The secondary air 12 is supplied through an annular gap 11 in the embodiments of FIGS. 1 to 4, which is next to the burner 3. In the embodiment of FIG. 5 an overlapped air gap 11*a* is formed in a region further out from the burner 3 by a special construction of the burner area, by means of which the secondary air 12 is similarly guided from below the cooking surface 1 to the burner ring 3*b*. Also in this embodiment the secondary air 12 can be further assisted by a blower 12 according to FIG. 1.

In the embodiment of FIG. 5 the annular gap 11 next to the burner is covered by an annular cover plate 14.

Besides what has been disclosed for the embodiments of FIGS. 1 to 4, especially in regard to possible modifications of the vessel support, of the overflow protection device and the like, is also true for the embodiment of FIG. 5.

Figure 6:
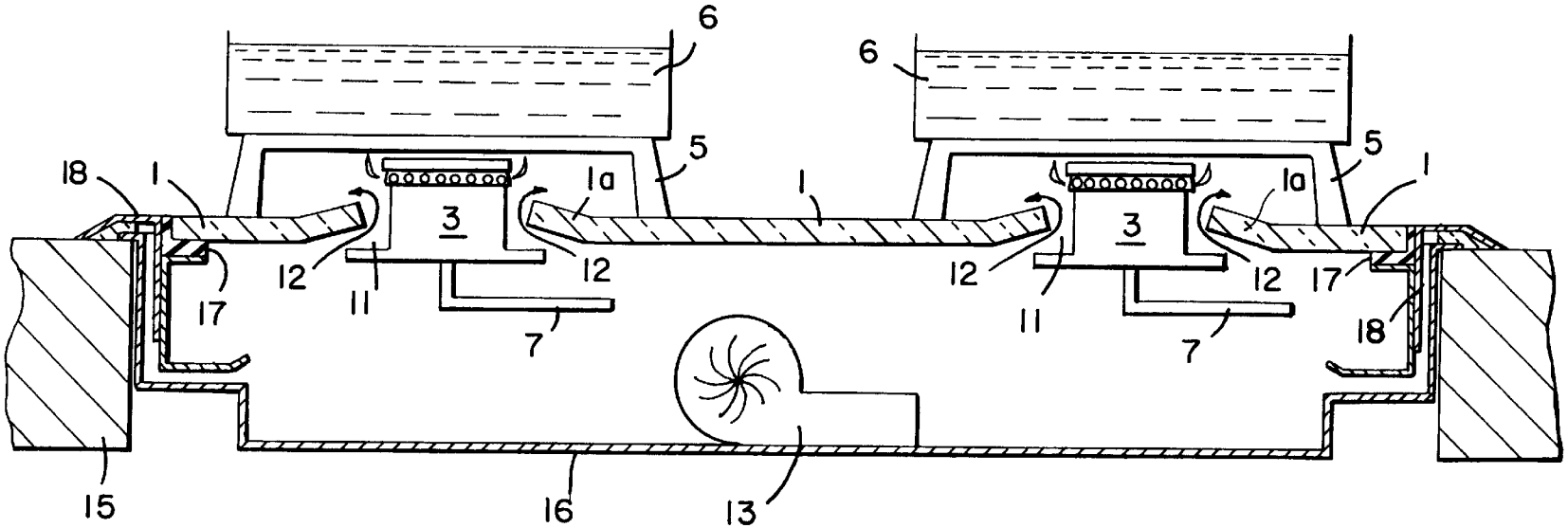
FIG. 6 is a schematic side cross-sectional view of the cooking apparatus according to the invention with two of the gas burners formed according the embodiment shown in FIG. 2.

FIG. 6, for example, shows a cross-sectional view through a complete gas cooking apparatus according to the invention with two gas burner units similar to those shown in FIG. 2, in which a bottom sheet 16 with a cooking trough is arranged in an opening provided in a work place 15, for example a counter top. The glass-ceramic plate 1 is fastened into with a holding and decorative frame 18 that is similarly held in the conventional manner in the opening by means of adhesive beads 17.

The blower 13 is mounted on the bottom sheet 16. An excess pressure can be produced by the blower to assist the supplying of the secondary air in the entire inner region relative to the exterior according to the form of the trough region. In this case the Venturi portion of the primary air supply in the feed pipe 7 is taken from this overpressure by suitable (unshown) partition plates. In another embodiment the secondary airflow from the blower 13 is guided into the air gap 11 by suitable channels, so that the remaining region of the trough interior can again remain under normal atmospheric pressure.

Figure 7:
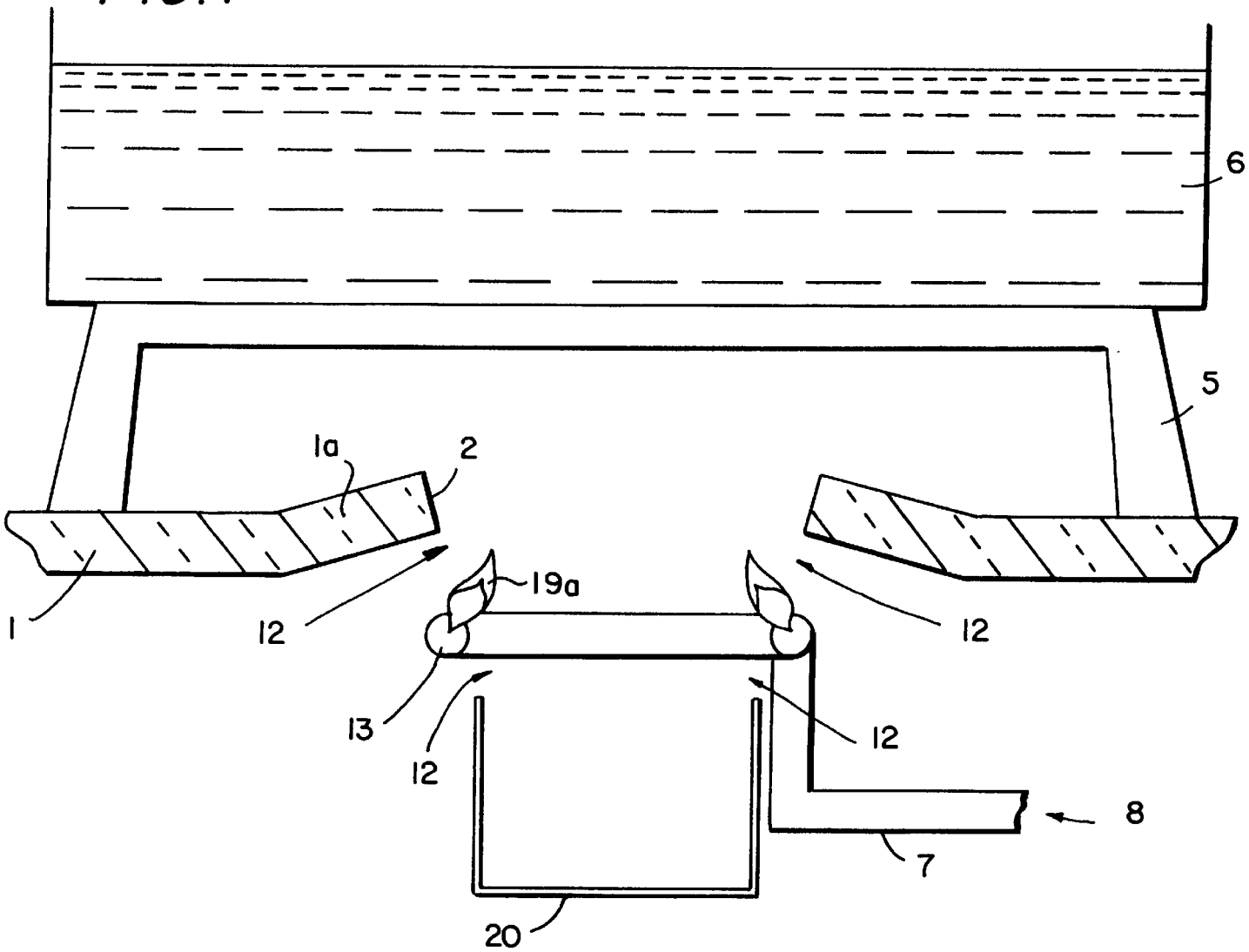
FIG. 7 is a schematic side cross-sectional view of the cooking apparatus according to the invention having an atmospheric gas burner arranged under the opening in the glass-ceramic plate.

FIG. 7 shows another especially preferred embodiment of the invention. The form of the opening 2 in the glass-ceramic plate 1 of the cooking surface with the upwardly curved or raised edge 1*a* and of the vessel support 5 correspond to that of the embodiment of FIG. 3, i.e. that latter embodiment provides the basis for this embodiment.

A circular-shaped burner 19 is provided under the cooking surface 1 in the embodiment of the cooking apparatus according to the invention shown in FIG. 7. This circular burner can be arranged at the same level as the opening 2 of the cooking surface in a structural variation from the embodiment of FIG. 3.

The flames 19*a* of the circular burner 19 burn on an inwardly directed circle and/or are directed vertically upward and/or at an arbitrary angle. The secondary air 12 is also guided from below the cooking surface 1 to the flames 19*a* in this embodiment. This can occurs from outside, i.e. directly under the glass-ceramic place bottom. Alternatively, it is conceivable that the secondary air 12 is fed from inside the circular burner 19. An overflow catching container 20 can be placed in the inner interior region under the burner ring to receive overflowing cooking material so that it is accessible from above.

Figure 8:
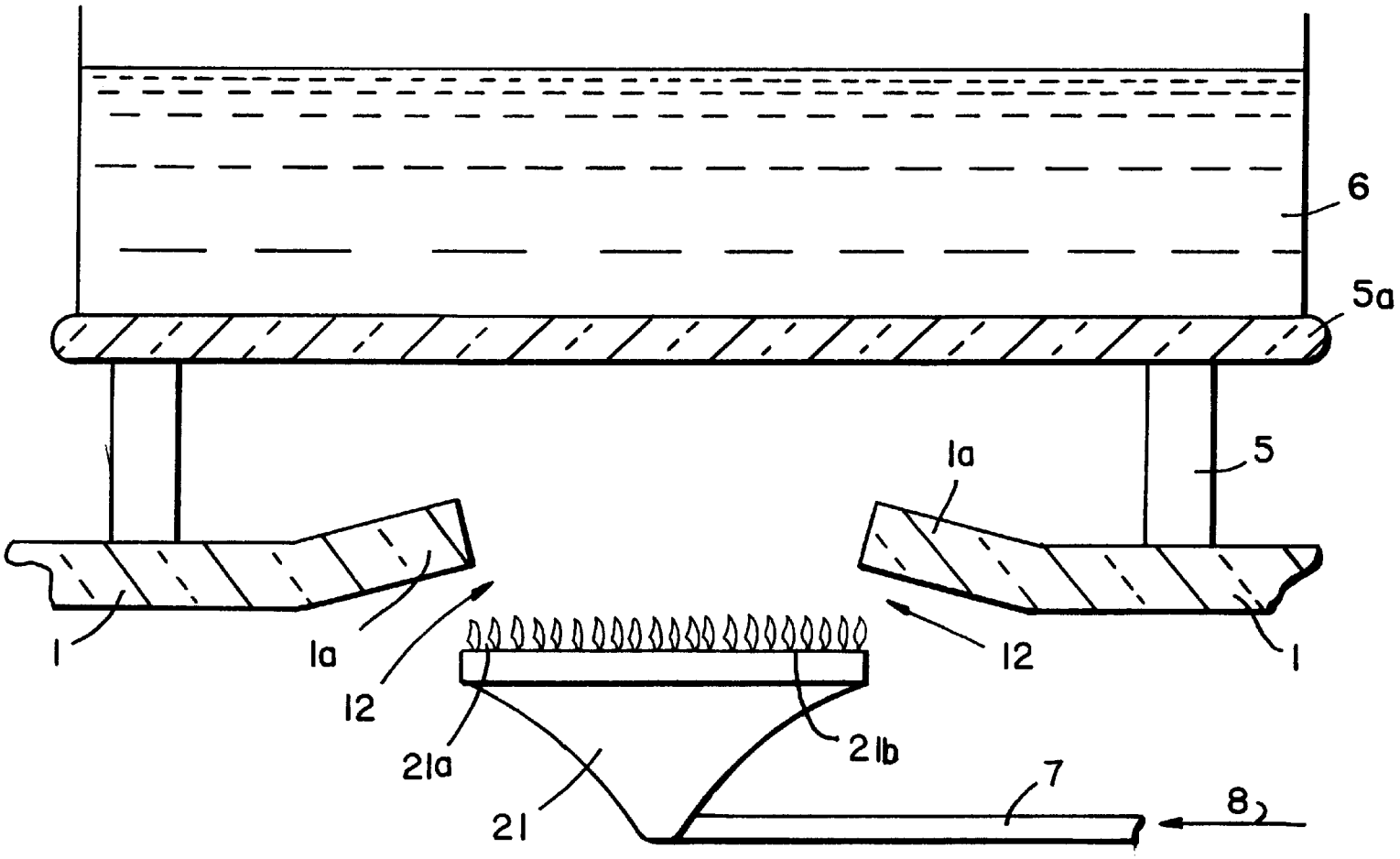
FIG. 8 is a schematic side cross-sectional view of a further embodiment of the cooking apparatus according to the invention with a gas burner unit with a hybrid burner arranged under the opening in the glass-ceramic plate.

FIG. 8 shows an additional embodiment of the invention that corresponds mainly to that shown in FIG. 7. However this embodiment has a glass-ceramic vessel-resting panel 5*a* mounted on the vessel support 5. Instead of the circular burner 19 in FIG. 7 in the embodiment of FIG. 8 a hybrid burner 21 is placed at the level of the glass-ceramic plate 1 or just below this location. The hybrid burner 21 is characterized by the transmission of a nominal part of the energy by radiation besides the energy transmission through open flames 21*a* (convection). The burning characteristics of the hybrid burner are achieved by the specific form of the burning surface 21*b*, which is formed by a metal screen or grid, by a ceramic or metallic fiber mat or web or ceramic element region. The combination of convective energy transmission and radiative transfer provide special advantages in that the vessel support 5 with a vessel resting panel 5*a* made from the same material as the cooking surface 1 is itself covered. The radiative transfer to the vessel bottom thus to a large extent takes place directly through the glass-ceramic vessel resting panel 5*a* and can thus contribute by providing short heat-up times and a rapid cooking system reactability. The hybrid burner 21 operates as a substantially pre-mix burner, i.e. the predominant amount of the air required is fed through the gas supply pipe 7 with the input combustible gas.

The hybrid burner 21 can be controlled to produce lesser power by on/off timing devices. Generally the special characteristics of these mixing burners in the control region are good. While the on/off timing is performed according to the embodiment and material of the burning surface and of the radiative part of the burner, because the hot surface do not cool so rapidly. This means that in on/off timing the radiative portion is always delivered equal-sized as a base load, which leads to an equalization of the delivered energy, which has the result of a very uniform, sensitive and responsive cooking control. Thus the control characteristics of this type of burner may be strongly influenced and adjusted to the respective cooking conditions by means of the ratio of the radiative part and the convective part of the burner.

The disclosure in German Patent Application 198 44 551.2 of Sep. 29, 1998 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a gas cooking apparatus and cooking vessel support for same, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

What is claimed is:

1. A cooking apparatus with a cooking vessel support, wherein said cooking apparatus comprises a glass or glass-ceramic plate (1) providing a cooking surface and having a cooking area on said cooking surface, said glass or glass-ceramic plate being provided with a throughgoing opening (2) in said cooking area, a gas burner arranged in or under said throughgoing opening (2) in said glass or glass-ceramic plate (1), said gas burner comprising means for supporting an open flame including a burner ring, and means (7) for supplying a mixture of combustible gas and primary air to said burner ring to form said open flame; and wherein said cooking vessel support is arranged on said glass or glass-ceramic plate (1) over said throughgoing opening (2), said cooking vessel support has a glass or glass-ceramic panel providing a resting surface for a cooking vessel (6) placed thereon and said resting surface is spaced a distance of less than or equal to 25 mm from said cooking surface provided on said glass or glass-ceramic plate (1).

2. The cooking vessel support as defined in claim 1, wherein said distance is less than or equal to 10 mm.

3. The cooking apparatus with the cooking vessel support as defined in claim 1, wherein said gas burner is an annular atmospheric gas burner (19).

* * * * *